US008360482B2

(12) United States Patent
Viviano

(10) Patent No.: US 8,360,482 B2
(45) Date of Patent: Jan. 29, 2013

(54) SPRING ACTIVATED ADJUSTABLE DEAD BOLT LATCH

(76) Inventor: Robert J. Viviano, St. Louis, MO (US)

( * ) Notice: Subject to any disclaimer, the term of this patent is extended or adjusted under 35 U.S.C. 154(b) by 738 days.

(21) Appl. No.: 11/993,179

(22) PCT Filed: Jun. 24, 2005

(86) PCT No.: PCT/US2005/023574
§ 371 (c)(1),
(2), (4) Date: Jan. 15, 2010

(87) PCT Pub. No.: WO2007/001311
PCT Pub. Date: Jan. 4, 2007

(65) Prior Publication Data

US 2010/0107707 A1 May 6, 2010

(51) Int. Cl.
*E05C 1/00* (2006.01)
*E05C 1/02* (2006.01)

(52) U.S. Cl. ..... 292/1.5; 292/DIG. 60

(58) Field of Classification Search ..... 292/1.5, 292/DIG. 60
See application file for complete search history.

(56) References Cited

U.S. PATENT DOCUMENTS 2,290,728 A * 7/1942 Best ..... 292/172
4,593,542 A 6/1986 Rotondi et al.
4,662,665 A 5/1987 Lin
4,687,239 A 8/1987 Lin
4,725,086 A * 2/1988 Shen ..... 292/1.5
4,759,576 A * 7/1988 Ching ..... 292/1.5
4,767,140 A 8/1988 Lin
4,895,404 A 1/1990 Toledano
4,921,290 A 5/1990 Dietrich
4,950,008 A 8/1990 Fang
4,957,315 A 9/1990 Lin
4,979,768 A * 12/1990 Marotto et al. ..... 292/337
5,498,037 A * 3/1996 Fan Lai ..... 292/1.5
5,551,264 A 9/1996 Fann et al.
5,562,314 A 10/1996 Wheatland et al.
5,957,510 A 9/1999 Kuo
6,318,769 B1 11/2001 Kang
6,401,297 B1 * 6/2002 Huang ..... 292/1.5
6,764,112 B2 7/2004 Lan-Shi et al.
7,393,022 B1 * 7/2008 Shan et al. ..... 292/1.5

* cited by examiner

*Primary Examiner* — Carlos Lugo
(74) *Attorney, Agent, or Firm* — Paul M. Denk

(57) ABSTRACT

A dead bolt latch (10) readily adjustable between forward and rear backset positions. A bolt casing (56) connects to a face-plate (48) installed on an outer face of a door (D). A bolt (15) fitting within the casing extends and retracts to latch or unlatch the door. A latch operator (12) and the bolt casing each have slots (64, 78) of a length corresponding to the distance between the backset positions, and a spring (72) seats between the bolt and latch operator. When the latch is being installed and needs to be adjusted between backset positions, the installer blocks movement of the bolt and then, by turning the latch operator, moves the relative position of the latch operator and bolt between backset positions using the force of the spring. This facilitates latch adjustment even by relatively unskilled installers.

16 Claims, 3 Drawing Sheets

SPRING ACTIVATED ADJUSTABLE DEAD BOLT LATCH

CROSS REFERENCE TO RELATED APPLICATIONS

The present application, as a National Stage filing, derives and claims priority from PCT/US2005/023574 having an international filing date of Jun. 24, 2005, published as International Publication No. WO 2007/001311 A1 which is herein incorporated by reference.

TECHNICAL FIELD

This invention relates to a dead bolt latch or the like having a backset adjustment capability; and more particularly, to such a door latch employing a spring so a backset adjustment is easy to accomplish.

BACKGROUND ART

Dead bolt latches used on doors employ a backset adjustment by which movement or throw of a latch's security pin or bolt can be set during installation of the latch. The "backset" is the distance between the forward or front face of a stationary casing portion of the latch and a transverse axis about which a latch operator moves to extend and retract the pin or bolt. This measurement is generally standard for most latches and is equal to ⅜" or 0.375" (0.95 cm) for an industry standard range of motion of between 2⅜ " and 2¾". The standardized construction permits a high degree of interchangeability between latches.

Within the latch industry, there is a need for latches which are quickly and easily adjustable between the two limits of backset measurements, it being understood that any adjustments are typically made by relatively unskilled workmen such as a homeowner, janitor or maintenance person, or the like. In U.S. Pat. No. 4,664,433 there is described a door latch construction in which a casing and bolt each include components one of which has a helical slot that engages a projection on another of the components. The slot and projection provide for longitudinal movement, in a helical manner, between a forward and rear backset position. While effective, this construction can be cumbersome for an unskilled person to adjust and obtain the proper backset.

SUMMARY OF INVENTION

The present invention, simply stated, is directed to a dead bolt door latch or the like which is easily adjustable between a forward and a rear backset position. A bolt casing is connected to a faceplate installed on the outer face of a door. The casing fits within an opening extending into the body of the door. A bolt seated within the casing is extendible and retractable by a latch drive operator movable by a mechanism connected to spindles movable by someone wanting to latch or unlatch the door. The latch operator and bolt casing each have slots of a length corresponding to the distance between the backset positions, and a spring is seated between the bolt and latch operator. When the latch is being installed and needs to be adjusted between backset positions, the installer blocks movement of the bolt and then, by turning the latch operator, can move the relative position of the latch operator and bolt between backset positions using the force of the spring. The use of the spring is a unique feature of the invention and facilitates automatic adjustment of the latch even by relatively unskilled installers.

Importantly, the latch is also a relatively low cost, high strength, highly secure latch that can be installed either as an original or a replacement latch, and, as noted, is easily installed even by those who do not ordinarily install latches. Further, when tested, the latch has been found to meet or surpass the Grade 1 requirements established by the American Nation Standards Institute (ANSI).

Other objects and features will be in part apparent and in part pointed out hereinafter.

BRIEF DESCRIPTION OF THE DRAWINGS

The objects of the invention are achieved as set forth in the illustrative embodiments shown in the drawings which form a part of the specification.

Corresponding reference characters indicate corresponding parts throughout the several views of the drawings.

BEST MODES FOR CARRYING OUT THE INVENTION

Figure 1:
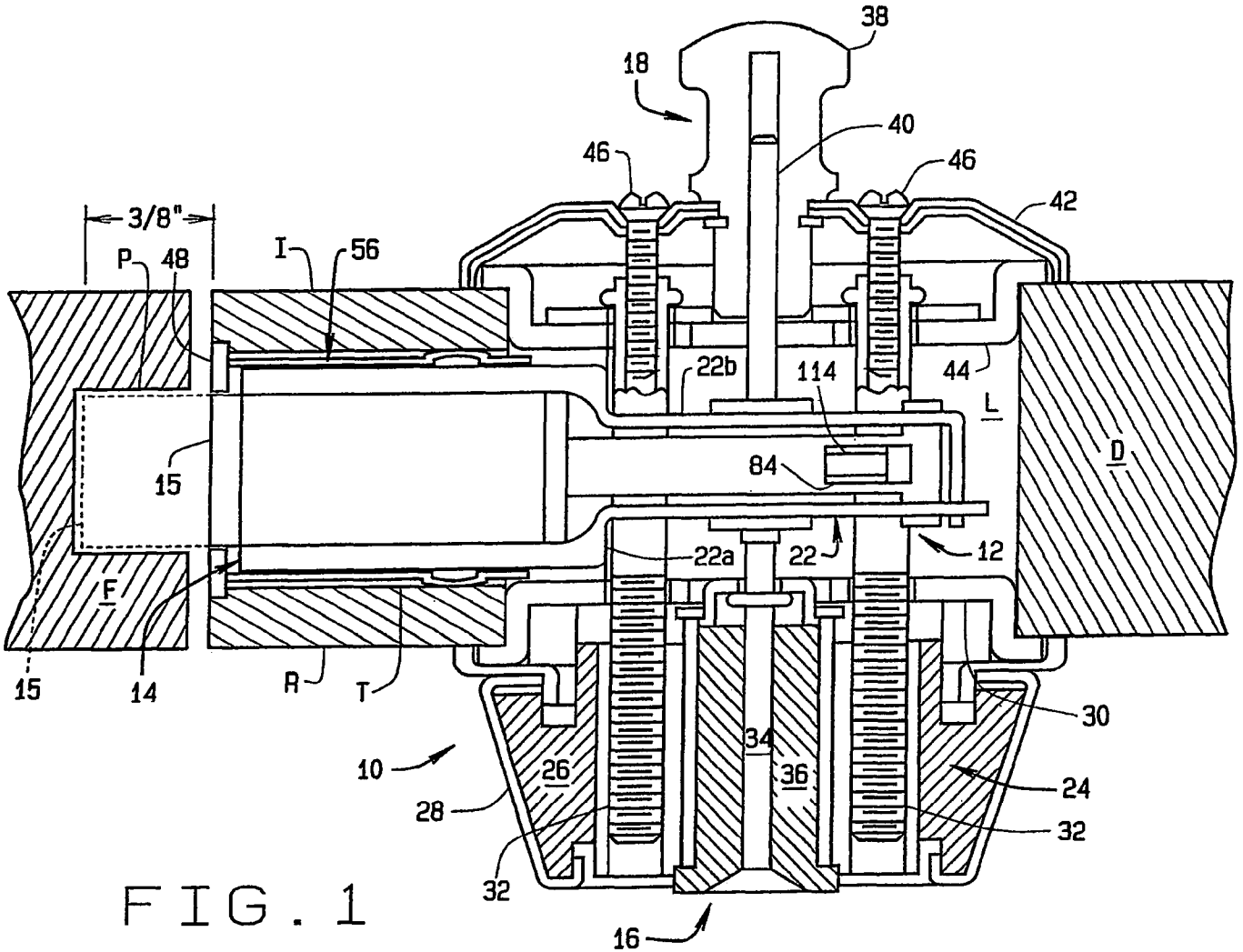
FIG. 1 is a sectional view of a dead bolt latch installation.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Referring specifically to the drawings, a dead bolt latch of the present invention is indicated generally 10. The latch is of a deadbolt type construction and is shown installed in a door D, the door having a latch opening L extending therethrough between respective inner and outer door faces I and R. Latch opening L transversely intersects a longitudinal latch opening T which extends from opening L to an outer door face C. Latch 10 includes a latch operating mechanism, indicated generally 12 and operably connected to a bolt assembly 14 for reciprocally moving the bolt assembly between extended and retracted positions. When extended to its dashed line position shown in FIG. 1, a bolt 15 of the bolt assembly extends into an opening P formed in a door frame F to latch door D closed. When retracted to its solid line position shown in FIG. 1, the bolt 15 is withdrawn from opening P and the door is unlatched, meaning it can be moved from a closed to an open position. The distance between these two positions, referred to as the "backset" or backset adjustment is ⅜" or 0.375" (0.95 cm).

Latch operating mechanism 12 comprises an outside operator assembly indicated generally 16 and an inside operator assembly indicated generally 18. Both of the operators are connected to a latch driving mechanism 20 which is movable within a frame 22 comprised of frame halves 22*a*, 22*b*. Outside operator assembly 16 comprises a standard cylinder lock assembly 24 which is installed adjacent outer face R of door D, enclosed within a conventional hardened guard collar and ring assembly 26, and housed within a cover assembly 28. The cylinder lock assembly, guard collar and ring assembly, and cover assembly are further secured by a reinforcing plate 30 together with a pair of bolts 32. A spindle 34 of the cylinder lock assembly extends into latch opening L through a lock plug 36 of the assembly. On the inside of door D, operator assembly 18 includes a knob 38 manually rotatable to turn a spindle 40 in either direction. The knob and spindle are installed in a cover assembly 42 which is secured to a reinforcing plate 44 using a pair of fasteners 46. For purposes of drawing clarity, and because the construction details and installation of these components are well-known in the art, they will not be further described.

Figure 2:
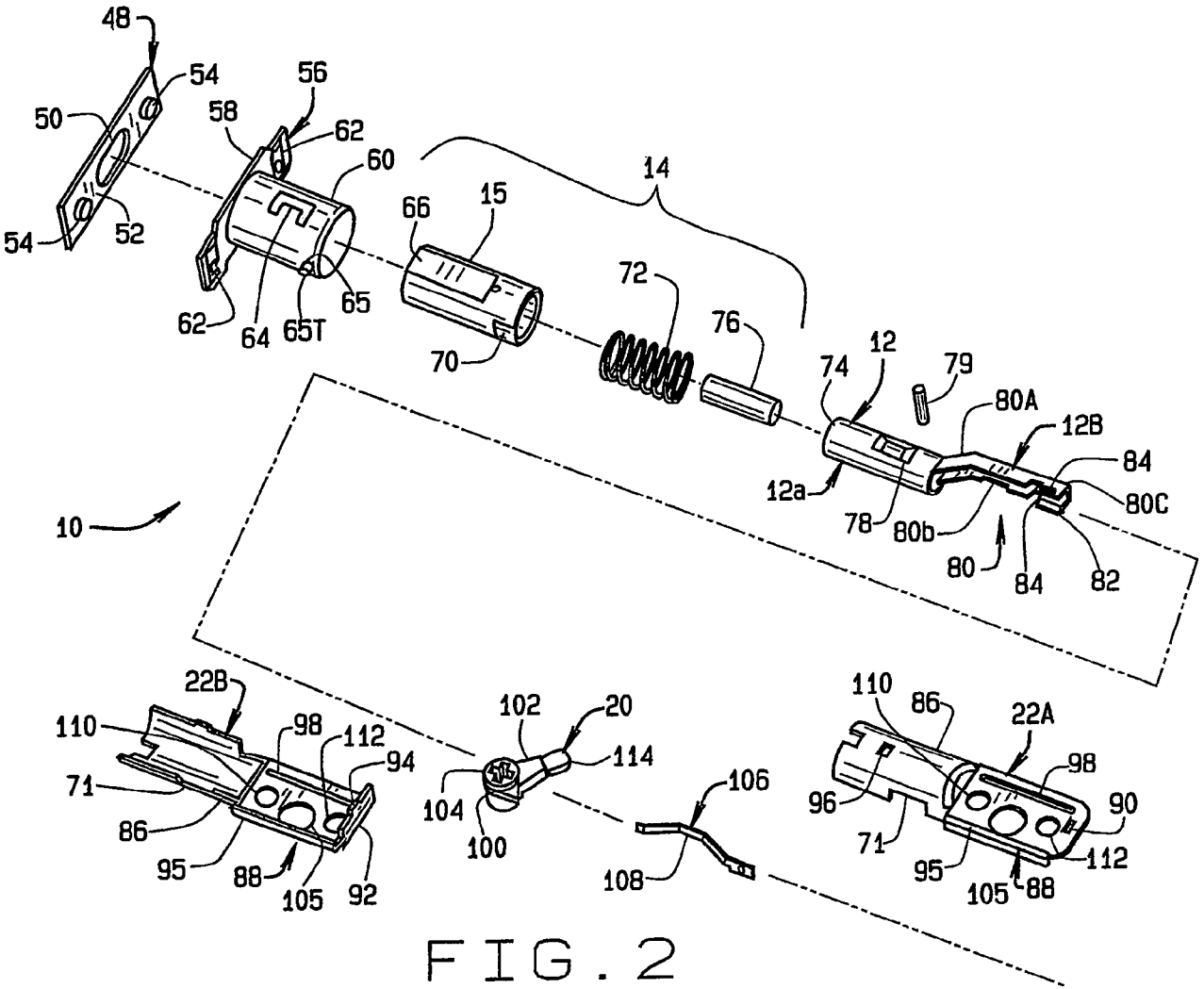
FIG. 2 is an exploded view of a first embodiment of the latch.

Referring to FIG. 2, a rectangular faceplate 48 is affixed to the outer edge of door D using screws or nails (not shown). The faceplate has a central opening 50 sized and shaped for the outer end of bolt 15 to project through the opening and into opening P in door frame F. Projecting inwardly from an inner face 52 of the plate, on opposite sides of opening 50 are hollow, relatively short or stubby projections 54. The projections are sized to receive screws or nails used to attach faceplate 48 to the to the door.

A bolt casing 56 includes a front plate 58 which abuts against inner face 52 of plate 48 when latch 10 is installed. The casing further includes a hollow cylindrical tube 60 which extends rearwardly of plate 58 into opening L. Tube 60 is sized to accommodate bolt 15, which is reciprocably movable through the casing as the latch operator assembly 16 or 18 is used to close or open door D. On opposite sides of tube 60 are H shaped openings 62. These openings are sized to receive the projections 54 of faceplate 48 and are used to align the faceplate and bolt casing so bolt 15 moves smoothly between its door open and door closing positions. Midway along the length of tube 60 is a U-shaped slot 64. The width of slot 64 corresponds to the length of the backset. Along the bottom of the tube, at the rear end thereof, is an inwardly turned tab 65. When dead bolt latch 10 is assembled, tab 65 extends upwardly through openings 71 formed in respective frame halves 22*a*, 22*b*, the tab fitting behind bolt 15. Both slot 64 and tab 65 provide locking points for the latch to add strength to the latch.

Bolt 15 comprises a hollow tube closed at its front end. Bolt 15 has opposed chamfered sections 66 only one of which is shown in FIG. 2. These chamfered sections extend from the closed front end of the bolt to a point somewhat past the midpoint of the length of the tube. Accordingly, when viewed from the front, bolt 15 has a rounded top and bottom, and straight sides. Opening 50 in faceplate 48 conforms to this shape. Rearward of the back end of each section 66 is an opening 68. Extending forwardly from the rear end of the bolt is another chamfered section 70. This chamfered section is intermediate the two sections 66 and is used for alignment of the bolt during latch assembly and installation.

Latch operator 12 comprises a front section 12*a* and a rear section 12*b*. Section 12*a* engages with bolt 15 to move the bolt and section 12*b* with drive mechanism 20. Section 12*a* comprises a hollow tube the outer diameter of which is slightly smaller than the inner diameter of bolt 15, so section 12*a* is inserted in the back end of the bolt. A coil spring 72 is sized to be inserted through the open end of bolt 15 for the forward end of the spring to seat against the closed end of the bolt. The back end of the spring seats against a front end 74 of section 12*a*. A hardened pin 76 is sized for insertion into section 12*a*. The pin prevents someone from cutting through the latch, and particularly bolt 15, to gain access to an area closed off by a door having latch 10 installed.

Latch operator section 12*a* has a U-shaped slot 78 formed approximately midway along the length thereof. Two such slots are formed in the tube (although only one slot is shown in the drawings), the slots 78 being diametrically opposite of each other. A locking pin 79 is inserted through the side of bolt 15 and extends orthogonally or diametrically across the bolt. The respective ends of pin 79 fit in the slots 78 to attach the bolt to the latch operator. Slot 78 is formed to be the same size and shape as slot 64 so, as with slot 64, the width of the slots 78 correspond to the length of the backset. Locking pin 79 moves through the slots to adjust the latch for the appropriate backset when latch 10 is being installed. Additionally, the slots 78 also help provide locking points to increase the strength of the latch.

Rear section 12*b* of latch operator 12 comprises an elongate plate 80 having three sections 80*a*-80*c*. Section 80*a* extends diagonally upwardly and backwardly away from the rear end of section 12*a*. Section 80*b* comprises a flat, generally horizontal extension of the plate. Section 80*c* comprises another flat, generally horizontal extension which is raised slightly above the level of section 80*b*. Section 80*c* has horizontal tabs 82 extending laterally outwardly from the rear portion of the section, and a rectangular opening 84 (see FIG. 1).

Frames halves 22*a*, 22*b* are essentially identically formed. Each half has a forward semi-circular section 86 and a rear flat plate section 88. The rear end of section 88 for half 22*a* has a rectangular slot 90 formed in it approximately halfway up the rear of the plate. The rear end of section 88 of half 22*b* is bent inwardly to form a back plate 92, which extends across the width of the rear portion of the frame. A tab 94, which is received in slot 90, extends outwardly from the outer end of plate 92. The bottom portion 95 of each plate section 88 is folded inwardly to for a base for the rear portion of the frame.

Insertion of tab 94 in slot 90 joins the two frame halves together. When so joined, the forward end of the resulting frame assembly is a hollow tube the outer diameter of which is slightly smaller than the inner diameter of tube 60 of bolt casing 56 for the front end of the frame to be slidably received in the tube. Frame half 22*a* has a projection 96 formed on the outside of its section 86. When the front end of frame 22 is inserted in tube 60, projection 96 is inserted into the U-shaped slot 64 formed in the side of the tube and movement of the frame relative to the bolt casing corresponds to movement of the projection through the slot.

Front end 74 of latch operator 12 is inserted into the hollow tube portion of frame 22. Rear section 12*b* of the latch operator fits in a space formed between the rear flat plate sections 88 of the frame. Each frame half has a longitudinal slot 98 extending the length of the rear section of the frame and the tabs 82 extending from plate 80 of the latch operator extend through the respective slots. Movement of the tabs through the slots guides movement of latch operator 12 through frame 22.

Latch driving mechanism 20 includes a cam 100 with a radially extending drive arm 102. Cam 100 has an X-shaped slotted opening 104 on each side for connecting the mechanism to the inner ends of the respective spindles 34 and 40. The inner ends of the respective spindles are inserted into frame 22 through openings 105 in the respective frame sections. A leaf spring 106 seats on the floor formed by the inwardly turned bottom portions 95 of each frame section, and the cam portion of mechanism 20 presses against a top of a central raised section 108 of the leaf spring. The leaf spring keeps mechanism 20 from "floating" within frame 22 and maintains a positive contact between the cam portion of the mechanism and the spindles. In addition to opening 105 in the sides of frame 22, the frame has two additional openings 110 and 112 on each side. These openings are sized to allow the frame to be fitted on the bolts 32 and fix the frame in place. Each opening 110 is forward of its associated opening 105, and the opening 112 is to the rear of the opening 105. As shown in FIG. 1, outer end 114 of arm 102 extends through opening 84 in frame 22.

Latch 10 is supplied to the installer already assembled. As so assembled, bolt 15 is in one of the two backset positions. As previously noted, and as shown in FIG. 1, the distance between these two positions is ⅜". For example, in one backset position, projection 96 on frame half 12*a* is in the forward vertical slot section of U-shaped slot 64 of bolt casing 60. Similarly, the ends of locking pin 79 are in the forward vertical section of the slots 78 in latch operator 12. It as part of the latch installation, it is determined the latch should be in the other backset position, all the installer needs to do is grasp the latch in one hand and block opening 50 in faceplate 48 with his thumb, a piece of tape, a block of wood, etc. Then, he seizes the back end of latch operator 12 and turns it counterclockwise.

When projection 96 clears the forward vertical section of the slot, the ends of locking pin 79 clear the forward vertical section of the slots 78. Spring 72 now drives latch operator 12 backwardly until projection 96 reaches the rear end of the longitudinal section of slot 64. At the same time, locking pin 79 is driven rearwardly until the outer ends of the pin reach the rear end of the longitudinal section of the slots 78. Now, the installer simply has to turn the latch operator clockwise to lock projection 96 in the rear vertical section of slot 64, and the ends of locking pin 79 in the rear vertical section of the slots 78. Adjustment of the latch is now complete.

If projection 96 on frame half 12*a* is in the rear vertical slot portion of slot 64 (the ends of locking pin 79 being in the rear vertical section of the slots 78 at this time), and it is determined that the latch should be in the other backset position, the installer reverses the above described operations. The only difference is that he will now have to push latch operator 12 forward, against the force of spring 72 to move projection 96, and pin 79 forwardly through the longitudinal section of their respective slots. Once the projection and the ends of the locking pin are in their forward vertical section of their respective slots, latch adjustment is complete.

Thereafter, in either instance, movement of bolt 15 is controlled by movement of latch operator 12 in response to the turning of mechanism 20 by spindle 34 or 40. Further, slot 64 and tab 65 on bolt casing 60, and the slots 78 on latch operator 12 act as locking points for the latch and serve to increase the strength of the latch. This is because the slots and tab prevent any backward movement of the latch when the latch is set to either backset position.

Figure 3:
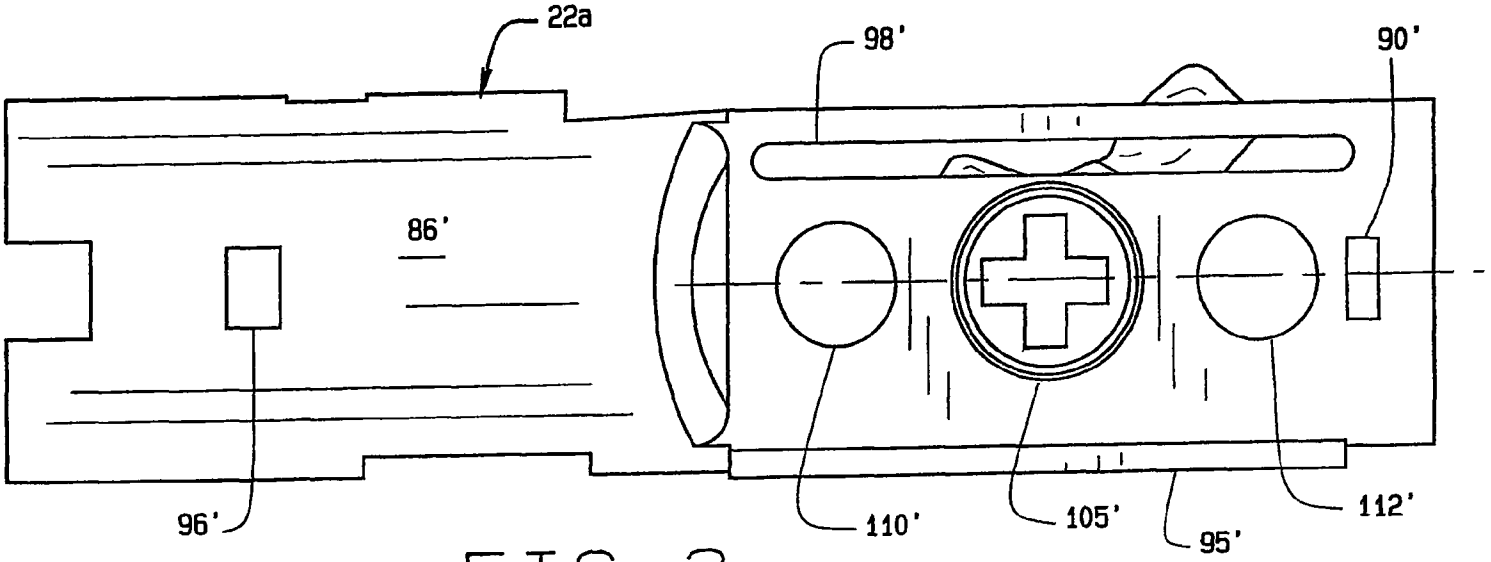
FIG. 3 is an elevation view of a second embodiment of a frame half of the latch.

As shown in FIG. 2, the centerline of the opening 105 in each frame half is below that of the centerline for openings 110 and 112. However, as shown in FIG. 3, in a second embodiment of the invention, a frame half 22' has openings 105', 110', and 112', whose centers are co-linear as indicated by the dashed line in the drawing. In this second embodiment, the corresponding openings in the other frame half (not shown) are identical.

Figure 4:
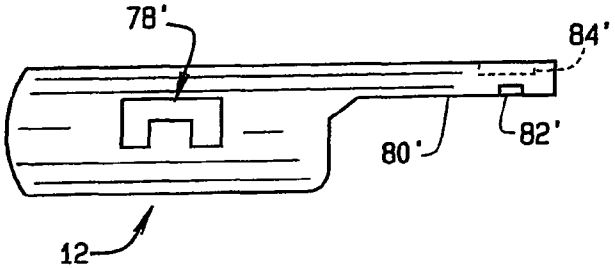
FIG. 4 is an elevation view of a second embodiment of the latch operator.

In the second embodiment of the invention, and as shown in FIG. 4, a latch operator 12*a* has a U-shaped slot 78' formed approximately midway along the length thereof. Again, two slots are formed in the tube diametrically opposite of each other. The rear section of latch operator 12' is again an elongate plate 80'. Now, however, plate 80' extends generally straight back from the front section of the latch operator as a horizontal extension of the front section of the latch operator. At the rear portion of plate 80' horizontal tabs 82' are formed, and these are received in the slots 98' of frame 22. A rectangular opening 84' is formed in the top of section 80' at the rear end of the section.

Figure 5:
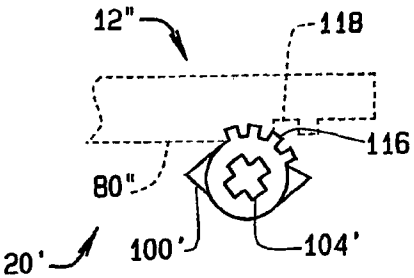
FIG. 5 is an elevation view of a second embodiment of the drive mechanism.

Finally, as shown in FIG. 5, a latch driving mechanism 20' has a rounded section 100' with an X-shaped slotted opening 104' on each side for connecting the mechanism to the inner ends of the respective spindles 34 and 40. Now, however, mechanism 20, section 100' has an arcuate toothed segment 116 extending partially around the outer circumference of the section. This toothed segment engages a complimentary toothed gear segment 118 formed on the bottom of a segment 80" of latch operator 12" to move the latch operator back and forth when spindle 34 or 40 rotates the latch drive mechanism. Again, movement of the latch drive operator 12" moves bolt 15 in one direction or the other to latch or unlatch door D.

In view of the above, it will be seen that the several objects and advantages of the present invention have been achieved and other advantageous results have been obtained.

The invention claimed is:

1. A dead bolt adjustable between one of two backset positions, comprising:

a bolt movable between one position for bolting a door and another position for unbolting the door;

a latch operator for moving the bolt, said latch operator comprising a front section which engages said bolt to move said bolt, and a rear section that moves the latch operator for moving said bolt, a latch drive mechanism cooperating with said rear section of the latch operator to move said bolt;

a pair of frames for mounting the latch operator;

an inside operator and an outside operator each operatively associated with said latch drive to provide means for manually moving said latch drive to move said bolt, an adjustment means including a casing surrounding said bolt and through which the bolt moves between said positions, said casing having a slot formed therein and which corresponds to the distance between the backset positions for the bolt, said adjustment means further includes a slot formed in the front section of the latch operator the length of which corresponds to the distance, between the backset positions, a pin provided through said slot in said front section of the latch operator that also extends through the bolt to adjust the length of the backset for the dead bolt, said adjustment means including a spring interposed between the bolt and latch operator for moving the bolt between one of the backset positions and to set the latch in a desired backset position, one of said frames having a projection that extends into said casing slot; and said casing having a tab, said tab extending within said frames and fitting behind the bolt to provide limits to the movement of said bolt when adjusted for backset, and a leaf spring biasing the latch drive into engagement with the rear section of the latch operator to maintain its connection when either the inside operator or the outside operator for the door are actuated for engagement or disengagement of the dead bolt during its operations.

2. The dead bolt of claim 1 in which the bolt is a hollow bolt closed at one end with one end of the spring seating against the closed end of the bolt.

3. The dead bolt of claim 2 in which one end of the latch operator is sized to fit within the hollow portion of the bolt with the other end of the spring seating against the end of the latch operator.

4. The dead bolt of claim 3 further including said locking pin for attaching the bolt to the latch operator for the bolt and latch operator to move together.

5. The dead bolt of claim 4 wherein a frame embracing the latch operator, said frame has opposed slots formed along a length thereof, respective ends of the latch operator fitting in the frame slots.

6. The dead bolt of claim 5 in which the slots in the casing and latch operator are U-shaped slots and the adjustment means facilitates locking the latch operator projection and the ends of the locking pin at one end of each of the slots so to set the latch to one of the backset positions.

7. The dead bolt of claim 6 in which setting the latch to the desired backset position includes blocking movement of the bolt through use of the casing tab, and then moving the latch operator so the projection and locking pin are simultaneously moved to one end of the two respective slots or the other, and then rotating the latch operator to set the projection and ends of the locking pin in a respective end section of the slots to lock the bolt in the desired backset position, the spring facilitating movement of the latch operator with respect to the bolt to move the latch operator between the ends of the respective slots.

8. The dead bolt of claim 1 further including a latch drive mechanism cooperating with said inside operator and the outside operator for moving the latch drive back and forth in a longitudinal direction to move the bolt between door locking and unlocking positions.

9. The dead bolt of claim 8 in which the latch drive mechanism is attached to a manually operable spindle for rotating the mechanism back and forth, the mechanism being operatively connected to the latch operator to convert rotary movement of the mechanism to longitudinal movement of the bolt.

10. The dead bolt of claim 9 in which the latch drive mechanism includes a radially extending arm an outer end of which is received in an opening in the latch operator for pivotal movement of the mechanism to produce a driving force on the latch operator to move the bolt.

11. The dead bolt of claim 9 in which the latch drive mechanism includes an arcuate toothed segment extending partially around an outer circumference of the mechanism, the segment engaging a complimentary toothed gear segment formed on the latch operator to move the latch operator back and forth.

12. The dead bolt of claim 8 in which the latch drive mechanism is housed within the frames of the latch operator and the latch operator has openings formed in opposites sides thereof for connecting the latch drive mechanism to manually operable spindles to rotate the mechanism.

13. The dead bolt of claim 12 in which additional openings are formed in the sides of the frames for embracing the latch operator adjacent the openings therein for the spindles to extend therethrough, the additional openings being for mounting means used to mount the latch operator in place when the dead bolt is installed.

14. The latch operator of claim 13 in which the respective openings are formed so their centers are co-linear.

15. The dead bolt of claim 13 wherein the additional openings of the frames are centered equally between the top and bottom edges of said frame for supporting the latch drive therein.

16. The dead bolt of claim 15 and including said frames having at least one additional opening for extension of at least one fastening bolt to secure the dead bolt latch to its associated door, and said latch operator openings and the at least one additional openings within the frames are in horizontal alignment.

* * * * *